US007896061B2

(12) United States Patent
Nakai et al.

(10) Patent No.: US 7,896,061 B2
(45) Date of Patent: Mar. 1, 2011

(54) PRODUCT HAVING IMPROVED ZINC EROSION RESISTANCE

(75) Inventors: Keiji Nakai, Osaka (JP); Tokumi Ikeda, Osaka (JP); Takahiro Hamada, Osaka (JP); Tsutomu Morikawa, Izumi (JP); Takashi Nishimura, Izumi (JP); Takuo Nakade, Izumi (JP)

(73) Assignees: Nomura Plating Co., Ltd., Osaka (JP); Osaka Prefectural Government, Osaka (JP)

( * ) Notice: Subject to any disclaimer, the term of this patent is extended or adjusted under 35 U.S.C. 154(b) by 410 days.

(21) Appl. No.: 11/795,557

(22) PCT Filed: Feb. 1, 2006

(86) PCT No.: PCT/JP2006/302113

§ 371 (c)(1),
(2), (4) Date: Sep. 11, 2007

(87) PCT Pub. No.: WO2006/082999

PCT Pub. Date: Aug. 10, 2006

(65) Prior Publication Data

US 2008/0149297 A1 Jun. 26, 2008

(30) Foreign Application Priority Data

Feb. 2, 2005 (JP) ..... 2005-026830

(51) Int. Cl.
*B22D 11/059* (2006.01)
*B22C 3/00* (2006.01)

(52) U.S. Cl. ..... 164/418; 164/138

(58) Field of Classification Search ..... 164/138, 164/418
See application file for complete search history.

(56) References Cited

U.S. PATENT DOCUMENTS 2,432,894 A * 12/1947 Holt et al. ..... 205/255
3,859,055 A 1/1975 Larsen

FOREIGN PATENT DOCUMENTS

| | | | |
|---|---|---|---|
| GB | 1 209 178 | | 10/1970 |
| JP | 47-4897 | | 2/1972 |
| JP | 59-50952 | | 3/1984 |
| JP | 1-108334 | | 4/1989 |
| JP | 4-269534 | | 9/1992 |
| JP | 5-163559 | | 6/1993 |
| JP | 6-25816 | | 2/1994 |
| JP | 06-246510 | * | 9/1994 |
| JP | 10-088385 | | 4/1998 |
| JP | 2001-105103 | * | 4/2001 |
| JP | 2004-276027 | | 10/2004 |
| RU | 2192509 | * | 11/2002 |
| SU | 422799 | * | 8/1974 |

* cited by examiner

*Primary Examiner* — Kuang Lin
(74) *Attorney, Agent, or Firm* — Wenderoth, Lind & Ponack, LLP.

(57) ABSTRACT

The objective of the present invention is to provide a product that is superior in barrier properties (for example, zinc erosion resistance and anti-adhesive property), abrasion resistant property, surface hardening property, thermal stability and life-time prolonging property. The product, which is made in direct contact with molten metal containing zinc in a molten state, is characterized by including an iron-tungsten alloy coating that is applied to a part or the whole of the surface of the product that comes directly in contact with the molten metal.

6 Claims, 2 Drawing Sheets

PRODUCT HAVING IMPROVED ZINC EROSION RESISTANCE

This application is a U.S. national stage of International Application No. PCT/JP2006/302113 filed Feb. 1, 2006

TECHNICAL FIELD

The present invention relates to a product that comes directly in contact with molten metal containing zinc in a molten state. In particular, the present invention concerns a casting mold of molten steel containing zinc as inevitable impurities and of brass containing zinc as an alloy component as well as a sink roll in a bath and a support roll, which is used in the hot dip galvanizing line of a rolling steel plate.

BACKGROUND ART

In a conventional example of a continuous casting mold used for steel, copper or a copper alloy that has a superior thermal conductivity has been used as a mold base material, and the inner face thereof is constantly came in contact with high-temperature molten steel. This is same situation in the case of a continuous casting mold made of brass. The inner wall of the casting mold to come in contact with the high-temperature molten steel receives severe damages, there has been a conventional trend that in an attempt to achieve abrasion resistance, heat resistance, etc., the surface of the casting mold inner face is coated with a coating material to prolong the service life of the mold, and at present, the trend has been unchanged. At the time when the continuous casting method was first introduced, starting with chromium plating, nickel plating or the like was then utilized, and in order to further improve the durability, coating materials, such as nickel-phosphorous alloys, nickel-iron alloys, cobalt-nickel alloys and nickel-chromium self-melting alloys formed through thermal spraying, have been continuously proposed. At present, these coating are appropriately combined and designed to form a best-suited coating structure for each mold for continuous casting machines and the resulting coating is used. Among continuous casting machines, there is an operation case in which scraps derived from, for example, zinc plated steel plates, are used during its molten steel producing process, and this trend is particularly strong upon casting in an electric furnace. When molten steel containing zinc as impurities is subjected to a casting process, the inner wall of a casting mold, in particular, a molten-metal-contact part (generally, referred to as meniscus position), is susceptible to erosion in the copper material and protective coating due to molten zinc, and the molten zinc is dispersed and invades through cracks in the protective coating to sometimes form alloys. Moreover, anchoring of zinc onto the surface of the mold frequently takes place, causing a further reduction in thermal conductivity and the resulting temperature increase in the molten metal contact part and reduction in the thermal fatigue resistant property of the copper base material, with the result that heat cracks tend to occur to damage the base material of the mold.

Patent Document 1 (Japanese Examined Patent Publication No. 04-2337) has proposed a technique for preventing adverse effects due to molten zinc, wherein cobalt or a nickel alloy containing 10 mass % or more of cobalt is utilized as a zinc dispersion preventive coating. As shown in Patent Document 1, a cobalt-based metal has the advantage that with respect to zinc in a molten state, the erosion rate is made slower in comparison with nickel-based metals; however, since cobalt is contained as a constituent component, the adhesive strength to zinc is comparatively high, resulting in the necessity of constantly removing adhered matters and the subsequent time-consuming, complex maintenance processes during operation are pointed out as a problem.

In recent years, under circumstances in which molten steel containing zinc as impurities is almost generally processed and there has been a strong demand for introducing an electromagnetic stirring method into a continuous casting machine so as to improve the quality of cast blocks. In accordance with this trend, the application of a mold base material having high permeability, or a low thermal conductivity, that is adopted so as to improve the stirring effect for molten steel, and an increased casting rate that is adopted so as to improve the productivity cause a higher temperature on the inner wall of the casting mold, in particular, on a molten metal contact face, with the result that the thermal fatigue resistant property further deteriorates. In this manner, adverse effects from the high-temperature meniscus position and an increase in the amount of molten steel cast containing zinc as impurities constantly cause occurrence of heat cracks in an earlier stage and an increase in the mold reproduction cycle as well as an increase in the amount of disposed molds.

Patent Document 2 (Japanese Patent No. 3004870) has described that by applying nickel plating to the surface of a base material made of copper or a copper alloy, and then by forming two or more chromium layers having a purity of 99% or more to provide a thickness of 25 μm or less, it becomes possible to delay erosion due to zinc from molten steel, and consequently to prolong the service life of the mold and the life time up to disposal thereof. Patent Document 3 (Japanese Patent Application Laid-Open No. 2004-237315) has proposed a method wherein two or more low-hardness chromium plated layers having a Vickers hardness of 600 or less are formed in a range with 300 mm from the upper end of the mold, and a cobalt alloy containing a predetermined amount of cobalt or nickel is placed as the under layer so that it becomes possible to prevent damages to the meniscus position of the casting mold.

Moreover, Patent Document 4 (Japanese Patent Application Laid-Open No. 10-156490) has proposed a method wherein at least a meniscus position of a mold that comes directly in contact with molten steel is coated with chromium plating having a single or two compression stress layers so that erosion due to zinc from the molten steel is prevented. In any of these techniques proposed by Patent Documents 2 to 4, chromium or chromium-based metal plating is applied so that the characteristic that the low affinity to zinc of chromium is utilized. In other words, these techniques utilize the electroplating that is easily applicable in the industrial point of view so that multiple chromium plating layers are prepared to reduce the possibility of cracks reaching the base material, or the number of cracks is reduced by making the hardness lower, or the cracks are prevented from expanding by applying a compression stress to the chromium plating layer. However, even in the case when the plated coating originally having cracks is made to have a low hardness to reduce cracks or when multiple layers are formed to avoid cracks from reaching the base material, since chromium itself has a small thermal expansion coefficient and is a metal having a low extension, in the event of an invasion of molten zinc, it is not possible to prevent the under metal layer from being eroded, even though the service life can be prolonged.

Patent Document 5 (Japanese Patent Application Laid-Open No. 2004-25244) has disclosed a method in which, in a vacuum chamber, an injection layer is formed on a specific portion of a copper mold material by directly ion-injecting a metal which has a high melting point and low affinity to zinc, such as chromium, molybdenum and tungsten, so that invasion of molten zinc is prevented. However, since a casting mold, which is a large-size structural object, needs to be housed in the vacuum chamber, the device inevitably becomes bulky, resulting in a problem of high costs.

Moreover, Patent Document 6 (Japanese Patent Application Laid-Open No. 08-132186) has disclosed a method in which a coating of a silicon polymer or a silicon compound is formed on the surface of a chromium plated inner wall face of a mold, and baked thereon at a temperature of 500° C. or less. In this method, the silicon compound is permeated into the cracks of the chromium plating layer and plugged therein so as to prevent zinc from invading therein. This method also requires a large-size furnace in the same manner as Patent Document 5, and causes problem with a permeating function of the silicon compound into cracks, resulting in failure of practical use.

Moreover, in Patent Document 7 (Japanese Patent Application Laid-Open No. 07-303942), a mold has been proposed in which: first, a first plated layer made of an alloy of cobalt or iron and phosphorous or a cobalt-iron-phosphorous alloy is formed on the surface of a mold base material, and a second plated layer made of a cobalt single layer is then formed, with a chromium plated layer being placed as the outermost layer. This mold attempts to prevent zinc invading from the chromium plating by using a low zinc erosion property of cobalt or a cobalt alloy; however, this method has failed to exert a satisfactory life-prolonging effect.

Here, Patent Document 8 (Japanese Patent Application Laid-Open No. 09-52152) has proposed a molten zinc erosion preventive method for a continuous casting mold of brass. In this method, a layer, which contains molybdenum, vanadium or molybdenum and vanadium in 60 mass % or more, with metals, such as copper or iron, cobalt and nickel, and an alloy of these being contained therein as the other components, is formed on a contact face of a mold made of copper or a copper alloy to molten metal with a thickness of 10 μm or more, by using a plating method, a thermal spraying method, a sputtering method, an ion plating method or a CVD method so that transfer of zinc in brass into flux and the resulting anchoring of zinc onto the mold surface are prevented. However, the formation of a plated coating containing 60 mass % of molybdenum and vanadium by the use of an electroplating method is impossible in principle, and the method is actually limited to the thermal spraying method, sputtering method, ion plating method, CVD method or the like, resulting in a problem with adhesion and requiring a special chamber; consequently, it is almost impossible to utilize this method in the industrial field.

Moreover, molten zinc or its alloy is plated on the steel plate to add rust preventive capability thereof, and with respect to countermeasures to molten zinc which adversely affects sink rolls and support rolls in this plating line, a thermal sprayed coating has been used in many cases. The reason for this is because the thermal spraying method has an advantage in that a composite coating made from various components such as carbides, nitrides and borates can be formed and because conventionally, the electroplating method has failed to produce a material that can withstand zinc in a molten state. Patent Documents 9 (Japanese Examined Patent Publication No. 07-13292) and Patent Document 10 (Japanese Patent No. 2986590) show examples in which the thermal sprayed coating is adopted.

DISCLOSURE OF THE INVENTION

Problems to be Solved by the Invention

An object of the present invention is to provide a product that comes directly in contact with molten metal which contains zinc in a molten state as impurities or in an intentional mixture state, and is coated with a coating which has both of a superior zinc erosion preventive property and heat resistance. Moreover, another object of the present invention is to provide a continuous casting mold that has a greatly prolonged service life. Still another object is to provide a sink roll and the like having a superior zinc erosion preventive property, which is utilized in an immersed state in a molten zinc bath.

Means to Solve the Problems

In order to solve the above-mentioned problems, the inventors of the present invention provides a method so as to examine the zinc erosion preventive property and heat resistance of a product that comes directly in contact with molten metal containing zinc in a molten state as impurities or in an intentionally mixed state, wherein in a temperature range from 450 to 500° C., the contact time to molten zinc is set to 15 hours, and at 600° C., it is set to 3 hours, so that a part that comes directly in contact with zinc in a molten state is evaluated on its zinc erosion preventive property and heat resistance (see Test Example 1 which will be described later).

Here, with respect to the material that can withstand zinc in a molten state, chromium plating is considered to be a relatively desirable material as a known coating material. However, actually, there have not been any documents that systematically compare and examine an issue of reactivity of a coating resulting from contact between the coating of each of various types utilized as a protective coating and zinc in a molten state, that is, the degree of attack by zinc to the coating or the material, or the degree of damages (erosion), and the presence or absence of anchoring (adhesion) of zinc to the coating and the material. With respect to various kinds of coating and materials including those known in the art, the inventors of the present invention have observed and evaluated erosion by zinc when made in contact with zinc in a molten state for a long time, adhesion (anchoring property) thereof and changes in the coating or the material, in detail. After various research efforts by using the previously established testing method, they have found that tungsten is the best suited material (see Test Example 2 which will be described later).

However, since it is impossible in principle to carry out an electroplating process of the pure tungsten, from an aqueous solution, the inventors have further examined a tungsten alloy that is suitable for electroplating. As a result, the inventors have found that, surprisingly, an alloy between iron and tungsten exerts extremely superior properties as a plated coating material used for members such as a casting mold and a sink roll (see Test Example 3 which will be described later), and further carried out studies to complete the present invention.

In other words, the present invention relates to the following aspects:

(1) a product which is made in direct contact with a molten metal containing zinc in a molten state, wherein a part or the whole of the surface of said product directly contacting with said molten metal is coated with an iron-tungsten alloy coating;

(2) the product according to the above (1), wherein the component other than zinc in the molten metal is one or two or more element (s) selected from the group consisting of iron, copper and aluminum;

(3) the product according to the above (1) or (2), wherein the content of tungsten in the iron-tungsten coating is not less than 10 mass %;

(4) the product according to the above (1) or (2), wherein the content of tungsten in the iron-tungsten coating is 20 to 60 mass %;

(5) the product described in any one of the above (1) to (4), which is used as a casting mold for molten steel containing zinc as impurities or for brass containing zinc as an alloy component, or as a sink roll in a bath or a support roll that is used in the hot dip galvanized line of a rolled steel plate;

(6) the product described in any one of the above (1) to (5), wherein the thickness of the iron-tungsten alloy coating is not less than 0.5 μm;

(7) the product described in any one of the above (1) to (5), wherein the thickness of the iron-tungsten alloy coating is 10 to 300 μm;

(8) a continuous casting mold, wherein a part or the whole of the inner surface of the mold is coated with an iron-tungsten alloy coating;

(9) the continuous casting mold according to the above (8), which is a continuous casting mold for molten steel containing zinc as impurities or for brass containing zinc as an alloy component;

(10) a roll for hot dip galvanizing, wherein a part or the whole of the surface of the roll is coated with an iron-tungsten alloy coating; and

(11) the roll for plating molten zinc according to the above (10), which is a sink roll in a bath or a support roll used in the hot dip galvanizing line for a rolled steel plate.

Effects of the Invention

The product of the present invention is superior in barrier properties (for example, erosion resistance and anti-adhesive property), abrasion resistant property, surface hardening property, thermal stability and life-time prolonging property.

REFERENCE NUMERALS

Figure 1:
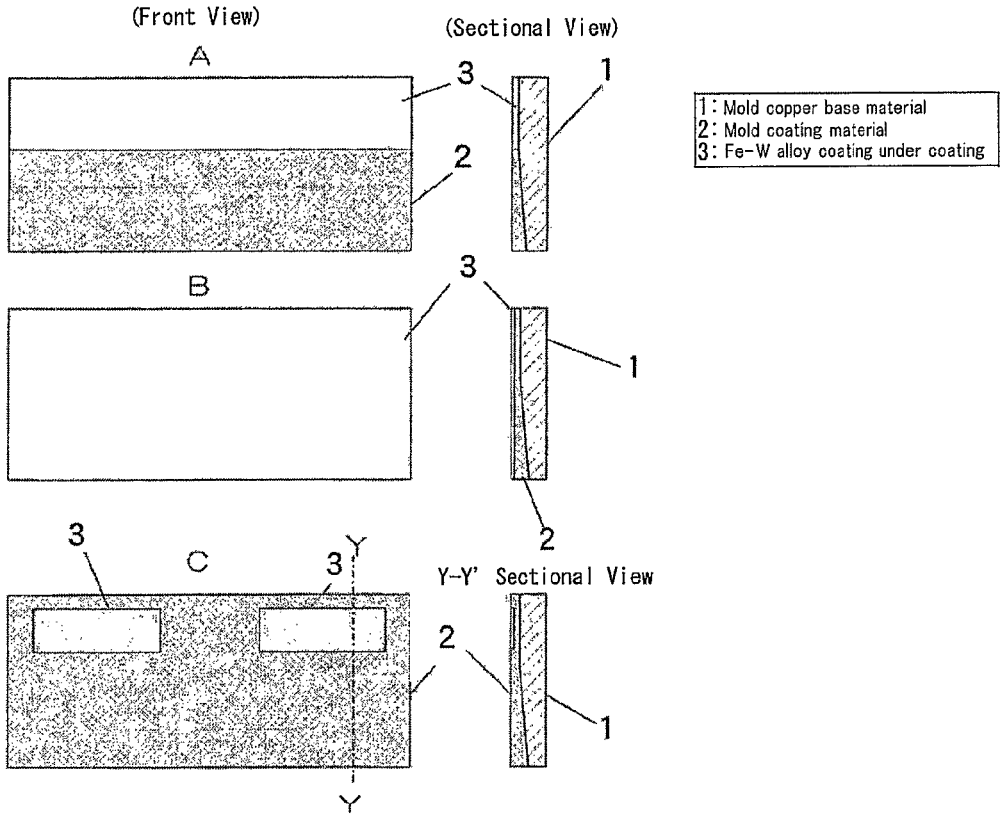
FIG. 1 shows an example of application of an iron-tungsten alloy coating to a molten slab steel face of a steel continuous casting mold.

1 Mold steel material
2 Mold coating material
3 Fe—W alloy coating
4 Fe-53.9 mass % W
5 Fe-12.3 mass % W
6 Sargent Cr
7 Ni-10 mass % Co
8 Fe-50.0 mass % W

BEST MODE FOR CARRYING OUT THE INVENTION

A product in accordance with the present invention, which is made in direct contact with molten metal containing zinc in a molten state, is characterized by including an iron-tungsten alloy coating with which a part or the whole of the surface of the product is coated.

The above-mentioned "molten metal" is not particularly limited, as long as it is a molten metal containing zinc. The molten metal contains components other than zinc in a molten state, and although not particularly limited as long as they do not impair the object of the present invention, the other components except for zinc contained in the molten metal may include iron, copper, aluminum and an alloy thereof. Here, the above-mentioned molten metal includes zinc in a molten state; however, the content, etc. of zinc are not particularly limited, and zinc in a molten state may be contained as impurities, or zinc in a molten state may be intentionally contained therein. Examples of the molten metal containing zinc in a molten state as impurities include a molten steel and the like. Examples of the molten metal intentionally containing zinc in a molten state include a molten brass, a molten metal in a molten zinc bath and the like.

With respect to the kinds of the above-mentioned "product", not particularly limited, any product may be used, as long as it comes directly in contact with a molten metal containing zinc in a molten state. Those types of products include, for example, a continuous casting mold, a roll used for hot dip galvanizing, and a mold for a zinc die cast. With respect to the continuous casting mold, a continuous casting mold for molten steel containing zinc as impurities or for brass containing zinc as an alloy component is listed as a preferable example. Moreover, with respect to the roll used for hot dip galvanizing, a sink roll in a bath and a support roll that are used in the hot dip galvanizing line of a rolled steel plate are listed as preferable examples.

The above-mentioned "iron-tungsten alloy coating" is not particularly limited as long as it is a coating made of an iron-tungsten alloy, and this may further contain inevitable impurities. The content of tungsten of the iron-tungsten alloy coating is preferably 10 mass % or more, more preferably 20 to 60 mass %. Moreover, the thickness of iron-tungsten alloy coating is preferably 0.5 μm or more, more preferably 0.5 to 1,000 μm, most preferably 10 to 300 μm.

In the present invention, the iron-tungsten alloy coating is formed on a part or the whole of the molten metal contact face of the product, and more specifically, for example, in the case where the product is a slab-use continuous casting mold, as shown in an example of FIG. 1, the coating may be applied to a portion that is most susceptible to erosion from zinc contained in a molten steel in a limited manner.

(Production Method)

The product of the present invention is produced by coating a part or the whole of the surface of a mold base material corresponding to a contact face to a molten metal with an iron-tungsten alloy. Here, this base material may be basically the same one as the product of the present invention except that it is not coated with, for example, an iron-tungsten alloy (hereinafter, referred to as product base material), or may be a material obtained in the middle of a production process, such as typically represented by a product base material wherein a part or the whole of the surface corresponding to a contact face to a molten metal of which has already been coated with another metal, such as an alloy of iron or/and cobalt and nickel.

With respect to the plating solution used for applying the iron-tungsten alloy coating and the method of plating, not particularly limited, conventionally known plating solutions and methods may be utilized. For example, plating solutions, made from ferrous salt (ferrous sulfate or the like), tungstate (sodium tungstate or the like) or organic chelating agent (ammonium tartrate or the like), are used. With respect to the method, for example, electroplating may be used. Here, from the viewpoint of stability in long-term coating quality, a method, which uses a plating device wherein a plating chamber that houses a cathode (product to be coated with an iron-tungsten alloy) and a plating solution and an anode chamber that houses an unsoluble anode (for example, platinum, iridium oxide, etc.) are separated from each other by an ion exchange film, and a method, which uses a device wherein a soluble electrode such as iron and tungsten is housed in the plating chamber of the above-mentioned device, may be utilized.

EXAMPLES

Test Example 1

In the continuous casting process of steel, the surface temperature of a meniscus position is generally considered to be 300° C. by temperature measurements during operation by a thermocouple embedded in a casting mold. However, in the case when the surface temperature becomes 400° C. or higher from the observation of the metal structure and the hardness change in the coating formed on an used casting mold as well as in a base material itself, in particular, in the case of a casting mold of a continuous casting machine with an electromagnetic stirring function that has been recently used in many cases, a copper material, which has a low thermal conductivity, tends to be used as a base material so as to increase the permeability so that the temperature of the meniscus position becomes relatively higher, and is estimated to be raised to 500° C., in a specific case, to 600° C. Here, the melting point of zinc is 419.6° C. In contrast, the operating temperature of the hot dip galvanizing bath is generally set to a temperature range of 470° C. to 480° C. Under such circumstances, upon carrying out contact tests (hereinafter, referred to simply as molten zinc tests) between molten zinc and various materials, first, the test temperature and the contact time to molten zinc are determined. With respect to the test temperature, since it is determined to use a temperature higher than the melting point of zinc, the lowest temperature is set to 450° C., and a temperature slightly higher than temperatures that are often used in hot dip galvanizing, that is, 500° C., and a temperature that is considered to be highest as the temperature in the vicinity of a meniscus portion of the continuous casting mold, that is, 600° C., are selected. Here, the contact time to molten zinc is determined in terms of an erosion state by molten zinc of a material obtained from machining ES70 (chrome-zirconium-copper) made by Chuetsu-Metal Works Co., Ltd., which is often used as copper material for use in electro-magnetic stirring, and oxygen-free copper containing phosphorous (phosphorous-copper alloy), as shown in FIG. 2.

Figure 2:
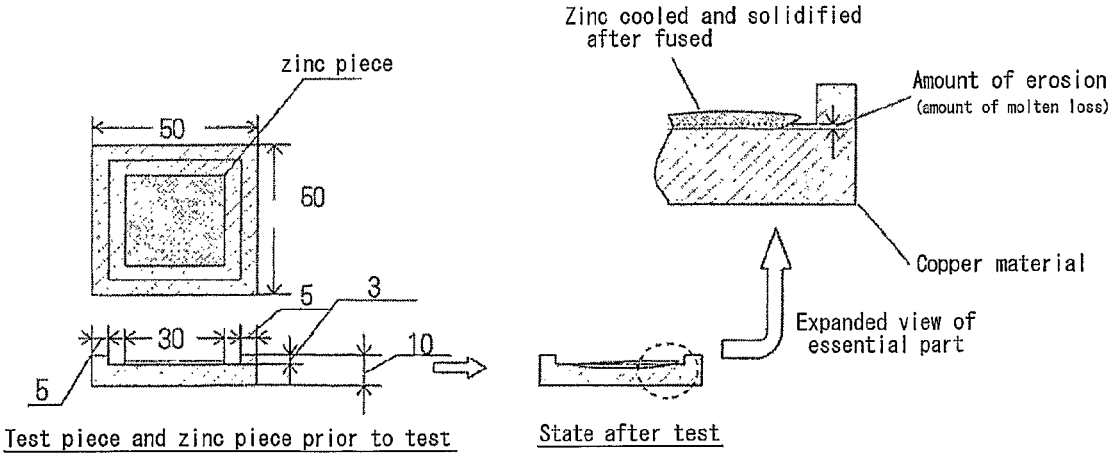
FIG. 2 shows a sequence of measuring procedures of an amount of erosion (molten loss amount) by zinc after a molten zinc test.

FIG. 2 shows a state in which a zinc piece prior to being charged into a heating furnace (purity: >99.8%, dimension: 30 mm×30 mm×0.5 mm in thickness) is attached to a test piece. Moreover, FIG. 2 shows a sequence of measuring processes on the amount of erosion (molten loss amount) by zinc after a molten zinc test. Moreover, the following Table 1 shows the thickness of erosion in a copper material caused by molten zinc.

In a contact between a copper material and molten zinc for a short period of about 1 to 2 hours at 450 to 500° C. of a molten zinc test with the copper material preliminarily carried out, the copper and zinc are not sufficiently reacted with each other to indicate that an acceleration test which can reproduce a state that is actually exerted in an actual continuous casting mold having an electromagnetic stirring function is not prepared and that a difference caused by kinds of copper materials is not clearly found; therefore, when temperatures of 450° C. and 500° C. are selected as molten zinc test conditions thereafter, the contact time to molten zinc after the temperature rise is set to 15 hours, and in the case of 600° C., it is set to 3 hours, and searching processes for materials and coatings that are resistant to erosion by molten zinc are carried out. Here, the following description will discuss erosion by molten zinc by exemplifying a case using copper: in this phenomenon, since zinc is dispersed in copper to be formed into an alloy while copper is being also dispersed in zinc, the copper material becomes thinner, and both of reductions in combination are regarded as an amount of erosion; however, with respect to materials other than copper, alloy-forming processes and thinning processes are observed in the same manner, and these are evaluated as an amount of erosion in the same manner.

Test Example 2

As the results of the preliminary test of Test Example 1, since the molten zinc test conditions had been basically determined, typical candidate materials were selected as shown in Table 2, and prior to the tests, each surface of those was precisely polished to a surface roughness of 2 μRz or less, and after this had been cleaned by an organic solvent, molten zinc tests were carried out thereon at 450° C., 500° C. and 600° C. The dimension of each test piece was set to the same as the preliminary test using the copper material; however, a step-difference machining with a width of 5 mm around the test piece, shown in FIG. 2, was omitted, and the resulting test piece was used. With respect to the thickness, those having a thickness in a range of 3 to 10 mm were used from the viewpoint of convenience of availability for materials. As the results of these tests, metals, such as iron (S25C), tungsten, chromium and cobalt, exerted a preferable erosion resistance to molten zinc, and in particular, it was found that tungsten was particularly superior in this property. Moreover, it was found that, depending on the kinds of metals, those metals could be classified into groups of three kinds, that is, a group in which no erosion was caused by molten zinc, or an amount of erosion was small even though eroded, with adhered zinc being easily separated after the test, a group which was opposite to the above-mentioned group and a group in which erosion and adhesion were caused by zinc. From the viewpoint of characteristics, the group in which no erosion was caused and separation was easily available was of course preferable.

TABLE 1

| | Contact temperature to molten zinc | | | | | |
|---|---|---|---|---|---|---|
| | 450° C. | | 500° C. | | 600° C. | |
| Contact time | Phosphorous copper alloy | ES70 | Phosphorous copper alloy | ES70 | Phosphorous copper alloy | ES70 |
| 1 hour | 0 | 0 | 0 | 0 | 330 μm | 346 μm |
| 2 hours | 0 | — | 0 | — | 500 μm | 489 μm |
| 3 hours | — | — | — | — | 713 μm | 726 μm |
| 15 hours | 225 μm | 239 μm | 560 μm | 548 μm | | |

(Note)

Temperature-raising and temperature-holding patterns of molten zinc tests are explained below, and after a test piece has been housed in a furnace, the atmosphere of the inside of the furnace is substituted by nitrogen gas, and then the furnace is maintained at a set temperature under a nitrogen gas flow of 2 L/min.

TABLE 2

| No | Kinds of materials and coatings | Contact conditions to molten zinc (numeric value: amount of erosion per unit time) 450° C. × 15 H | 500° C. × 15 H | 600° C. × 3 H | Adherence (anchoring) property of molten zinc*3 |
|---|---|---|---|---|---|
| 01 | Cr (Conventional material by metallurgy) | ≅0 | 0.3 μm/H | 13.0 μm/H | ○ |
| 02 | W (Conventional material by metallurgy) | 0 | 0 | 0 | ○ |
| 03 | S25C (Conventional material by metallurgy) | 1.3 μm/H | 4.4 μm/H | 17.0 μm/H | ○ |
| 04 | SUS304 (Conventional material by metallurgy) | 1.0 μm/H | 3.0 μm/H | 17.0 μm/H | ○ |
| 05 | Ti (Conventional material by metallurgy) | 1.8 μm/H | 6.0 μm/H | — | X |
| 06 | Hastelloy C*1 (Conventional material by metallurgy) | 1.9 μm/H | 13.0 μm/H | — | ○ |
| 07 | ES70*2 (Conventional material by metallurgy) | 17.0 μm/H | 37.0 μm/H | 133.0 μm/H | X |
| 08 | Ni (produced by an electroplating) | 2.3 μm/H | 6.8 μm/H | 31.0 μm/H | X |
| 09 | Co (produced by an electroplating) | ≅0 | 1.3 μm/H | 7.0 μm/H | X |

(Note)
*1Hastelloy C: Trade name of Satellite Co., Ltd. in Heinz, in the U.S.
*2ES70: Copper material made by Chuetsu-Metal Works Co., Ltd. utilized as a casting mold copper material used for electromagnetic stirring.
*3Explanation on symbols used in the column indicating adhesive property of molten zinc.
○: Even when made in contact with molten zinc, the solidified zinc was easily separated after the test.
X: When made in contact with molten zinc, zinc adhered to the surface was not separated after the test.

As described above, Table 2 shows that tungsten is the most suitable material for the molten zinc. However, this metal is incapable of being subjected to an electroplating process, which is a problem to be solved by the inventors of the present invention. In contrast, chromium, iron, and SUS304 which is an alloy of these are selectable from the viewpoint that no zinc anchoring takes place although these are eroded by zinc. Moreover, cobalt is comparatively superior in erosion resistance against zinc, although anchoring of zinc takes place; thus, any of these have many technical problems.

Text Example 3

An ES70 copper material that had the same external dimension as the test piece of FIG. 2, with a uniform surface and with a thickness of 10 mm, was prepared, and first, an iron-tungsten alloy (Fe—W) was formed on the surface thereof under the same bath composition and conditions as Example 1 which will be described later, and a cobalt-iron alloy (Co—Fe), a cobalt-tungsten alloy (Co—W), a nickel-tungsten alloy (Ni—W), etc. were formed thereon under known bath composition and conditions, and each of the resulting test pieces was subjected to a molten zinc test. Here, each of the test pieces was formed with a target coating thickness of 50 μm. The test results are shown in Table 3.

TABLE 3

Comparison of various coatings on molten zinc resistance and features thereof

| No | Tested coatings | Alloy composition | Bath used for manufacturing coating | Erosion rate by molten zinc (μm/H) 450° C. × 15 H | 500° C. × 15 H | 600° C. × 3 H | Determined adhesive property of molten zinc (changeable depending on contact temperature) 450° C. | 500° C. | 600° C. | Special Notes |
|---|---|---|---|---|---|---|---|---|---|---|
| 1 | Normal Cr plating (coating for use in comparison) | — | Sargent bath | 0 | 0.2 | 11.7 | ○ | X | X | Zinc invades through cracks to attack copper |

TABLE 3-continued

Comparison of various coatings on molten zinc resistance and features thereof

| No | Tested coatings | Alloy composition | Bath used for manufacturing coating | Erosion rate by molten zinc (μm/H) 450° C. × 15 H | 500° C. × 15 H | 600° C. × 3 H | Determined adhesive property of molten zinc (changeable depending on contact temperature) 450° C. | 500° C. | 600° C. | Special Notes |
|---|---|---|---|---|---|---|---|---|---|---|
| 2 | Low-hardness 2-layered Cr plating (coating for use in comparison) | — | High-emperature and high-concentration Sargent Bath | 0 | 0.7 | — | ○ | ○ | X | Same as the above |
| 3 | WC-Co Spraying (coating for use in comparison) | Co: 12 mass % | Ultrasonic-gas spraying | 0 | 0 | ∞ | ○ | ○ | X | Co is attacked at high temperature to damage coating |
| 4 | Co plating | — | Sulfamic acid bath | 0 | 1.3 | 6.7 | X | X | X | Eroded from the surface layer |
| 5 | Co—Ni alloy plating | Ni: 10 mass % | Sulfamic acid bath | 0 | 2.0 | 7.2 | X | X | X | Same as the above |
| 6 | Co—Ni alloy plating | Ni: 20 mass % | Sulfamic acid bath | 0 | 3.1 | 8.5 | X | X | X | Same as the above |
| 7 | Co—Ni alloy plating | Ni: 30 mass % | Sulfamic acid bath | 0.1 | 4.1 | 12.0 | X | X | X | Same as the above |
| 8 | Co—Fe alloy plating | Fe: 10 mass % | Sulfamic acid bath | — | 1.7 | 5.8 | — | X | X | Same as the above |
| 9 | Co—W alloy plating | W: 15 mass % | Citric acid bath | — | 2.3 | 9.0 | — | X | X | Cracks occur, and erosion takes place from the surface layer and the base layer |
| 10 | Ni—W alloy plating | W: 40 mass % | Citric acid bath | — | 8.8 | 24.0 | — | X | X | Eroded from surface with good wettability in molten zinc |
| 11 | Ni—Cr Self-melting alloy (coating for use in comparison) | fusing | Gas-spraying + | — | 13.0 | — | — | X | — | Eroded from surface although chromium effect is expected |
| 12 | Fe plating | — | Chloride bath | — | 7.0 | — | — | ○ | — | Erosion progresses from surface layer |
| 13 | Fe—W alloy plating | W: 45 mass % | Tartaric acid bath | 0 | 0 | 0 | ○ | ○ | ○ | Fine cracks occur in coating after molten zinc test |

(Note)
(1) The above-mentioned tests were respectively carried out twice so as to confirm reproducibility, and the results thereof are shown.
(2) In the Table, symbol ○ indicates easy peeling, and X indicates adhesion.

As clearly indicated by Table 3, although chromium plating certainly has a high erosion preventive property against the molten zinc, its chromium plated layer tends to be also eroded slightly as the temperature rises. Here, the biggest disadvantage is that the chromium plating has inherent cracks and zinc in a molten state tends to readily invade into the base layer to erode the border between the base layer metal and the chromium plated layer to greatly raise the chromium plated layer, resulting in disappearance of its barrier property. In this point, Japanese Patent Application Laid-Open No. 2004-237315 has proposed a structure that improves the disadvantage of the conventional chromium plating; however, this fails to prepare a complete barrier against molten zinc.

Although it has been confirmed that the tungsten carbide-cobalt thermal sprayed coating for use in comparison has a superior zinc erosion preventive property up to 500° C., cobalt that forms a binder for tungsten carbide is eroded in the case of a temperature exceeding 500° C., with the result that the coating is damaged to be completely separated from the base material to lose its function.

Here, it is confirmed that even when cobalt is formed into an alloy, the resulting alloy fails to exert the expected property. In other words, even when iron and tungsten are formed into alloys, the resulting alloys fail to exert their inherent properties that the respective metals independently exert, and any of these tend to be successively eroded by zinc from the surface or through cracks. It has been found that in this manner, even when only the advantages of the individual metals are combined with each other, it is very difficult to form a novel coating that can achieve the object.

Moreover, the following facts have been found: in the case of pure-iron plating, its properties are slightly different from those of carbon steel S25C that is produced as an alloy, although the reason for this has not been clarified, and the rate of erosion due to molten zinc is slightly higher, and in the case of a nickel-based alloy, the rate of erosion due to molten zinc and zinc adhesion are relatively high.

In contrast, in the case of an iron-tungsten alloy, no erosion due to molten zinc was found in any of testing temperatures, and no adhesion of zinc solidified after the cooling process was found; therefore, easy peeling was available. Moreover, although prior to the molten zinc test, no cracks were found on the iron-tungsten alloy coating in visual observation as well as in microscopic observation, slight cracks occurred depending on temperatures after the test. However, in this case, different from chromium plating in which molten zinc invades through cracks, such tendency was not found, and it was possible to obtain a very stable molten zinc barrier property.

As described above, it is found that only the iron-tungsten alloy can exert a superior molten zinc erosion preventive property, and with respect to the plating bath that produces (plates) an iron-tungsten alloy, any of known baths may be used, although only few studies have been made and only few bath types have been known. For example, a tartaric acid bath in which tartaric acid and its salts are used as a complexing agent, and a citric acid bath in which citric acid and its salts are used as a complexing agent are proposed. Any of these easily form an amount of tungsten at a comparatively fixed ratio in a state in which, in contrast, it is difficult to desirably control the content of tungsten in the coating, and the amount is about 40 mass % or more. In an attempt to intentionally change this amount, the concentration of the complexing agent, pH and current density can be adjusted. Moreover, the operation temperature is widely set, and conditions in a wide range from 30 to 90° C. can be adopted.

Example 1

Production of a Pseudo-Continuous Casting Mold

An iron-tungsten alloy bath, composed of 0.1 M ferrous sulfate, 0.1 M sodium tungstate and 0.3 M ammonium tartrate, was prepared, and under a condition of a bath temperature of 60° C., the pH and the current density were respectively changed from 5 to 9 and from 3 to 10 A/dm$^2$ so that iron-tungsten alloy coatings respectively having a tungsten content of 12.3 mass % used for Example 1-1, a tungsten content of 24.1 mass % used for Example 1-2, a tungsten content of 33.3 mass % used for Example 1-3 and a tungsten content of 53.9 mass % used for Example 1-4 were formed on one face of each object to be plated so that products were obtained. Each of the iron-tungsten alloy coating had a coating thickness of 50 μm. In the present Example, as the object to be plated, ES70 copper plates, each having a size of 100 mm in square×20 mm in thickness, were used as a sample of the base material of the product (continuous casting mold). Here, with respect to the tungsten content, each of the resulting products was cut into pieces, each having about 50 mm in square, to form evaluating test pieces, and some of the test pieces were evaluated by EPMA (EPMA8705 made by Shimadzu Corporation).

Comparative Examples 1 to 2

By using a general Sargent chromium bath and a sulfamic acid bath for obtaining a cobalt-10 mass % nickel alloy that is currently used in most cases as a coating for a continuous casting mold, each of a chromium plated coating and a cobalt-10 mass % nickel alloy coating was formed on one face of an ES70 steel plate having a size of 100 mm in square×20 mm with a target film thickness of 50 μm, and this was further cut into small pieces having about 50 mm in square to prepare evaluating test pieces.

Evaluation Example 1

With respect to the test pieces prepared in Example 1 and Comparative Examples 1 and 2, erosion resistant tests using molten zinc were carried out thereon by using the following processes, and the adhesive property of the solidified zinc after each of the tests was evaluated. The results of evaluations are shown in Table 4.

(Erosion Resistance Test)

With respect to each of the three test pieces, the erosion rate caused by molten zinc was determined under two conditions at 500° C. for 15 hours and at 600° C. for 3 hours, and the average value of these was obtained as the result of the test.

(Evaluation on Adhesive Property of Zinc Solidified after Tests)

With respect to each of the three test pieces after the erosion resistance tests, the case in which solidified zinc was easily peeled off was evaluated as "○", and the case in which solidified zinc was slightly difficult to peel off was evaluated as "Δ".

TABLE 4

| | W | Erosion rate by molten zinc | | Adhesive property of zinc solidified after test | | |
|---|---|---|---|---|---|---|
| | content (mass %) | 500° C. × 15 hours | 600° C. × 3 hours | 500° C. × 15 hours | 600° C. × 3 hours | Special note |
| Example 1-1 | 12.3 | 0.8 μm/H | 3.0 μm/H | Δ | Δ | — |
| Example 1-2 | 24.1 | ≅0 | 0.3 μm/H | ○ | ○ | No invasion of zinc |
| Example 1-3 | 33.3 | 0 | 0 | ○ | ○ | Same as the above |
| Example 1-4 | 53.9 | 0 | 0 | ○ | ○ | Same as the above |

As clearly indicated by Table 4, in an iron-tungsten alloy series, a particularly preferable tungsten content is present, and the content of at least 20 mass % or more is most preferable as a barrier against molten zinc.

Evaluation Example 2

The rest of test pieces having 50 mm in square formed in Example 1-1 and Example 1-4 was utilized to form small pieces having 10 mm in square, and each hardness of these was measured. Table 3 shows the coating hardness measured data. Moreover, with respect to Comparative Examples 1 and 2, the same test pieces having 10 mm in square were formed as test pieces, and each hardness of these was then measured, and Table 3 shows the results thereof. Here, with respect to the hardness measurements, each of the test pieces was heated under the respective thermal treatment conditions shown in FIG. 3, the Vickers hardness of each test piece after the treatment was measured.

Figure 3:
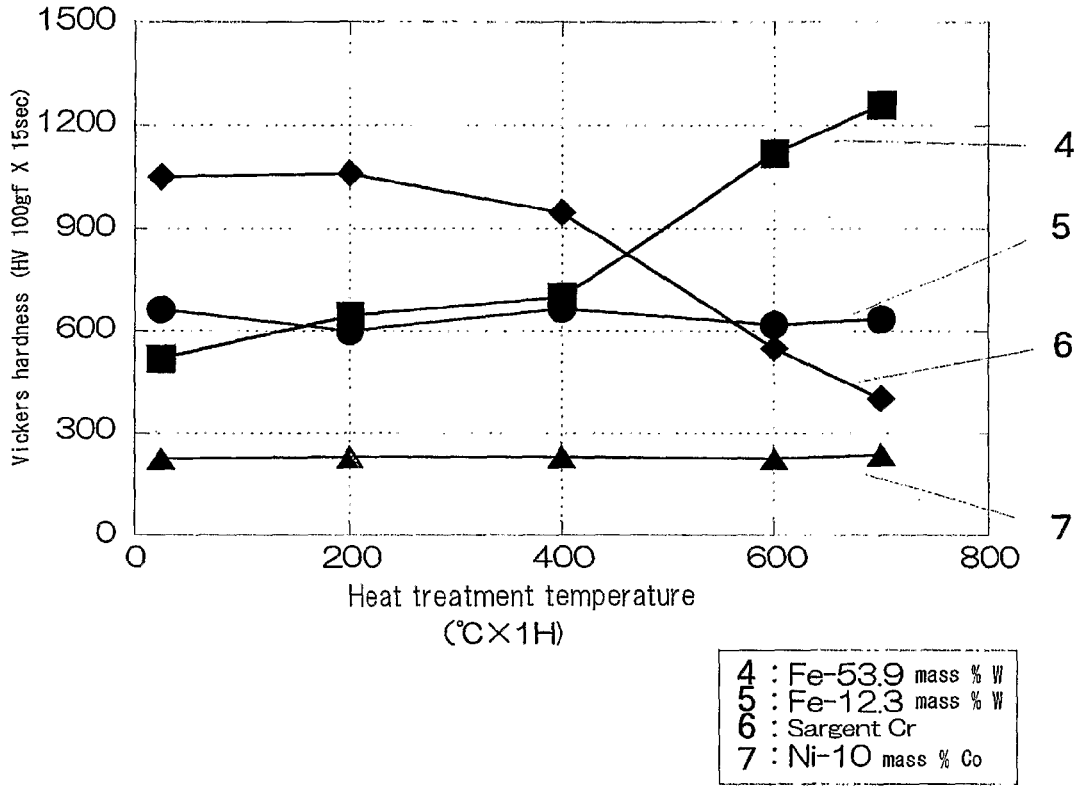
FIG. 3 shows hardness data of Fe—W alloy, Cr and Co-10 mass % Ni alloy coating.

As clearly indicated by FIG. 3, in comparison with data of chromium and cobalt-nickel alloy plating in Comparative Examples, data in Examples 1-4 include big changes in hardness behavior when heated, with the result that the hardness increases in proportion to an increase in the heating temperature. In contrast, data in Example 1-1 have small changes in hardness behavior when heated so that even when the temperature for heating changes, the hardness is kept stably in a high level.

Evaluation Example 3

Figure 4:
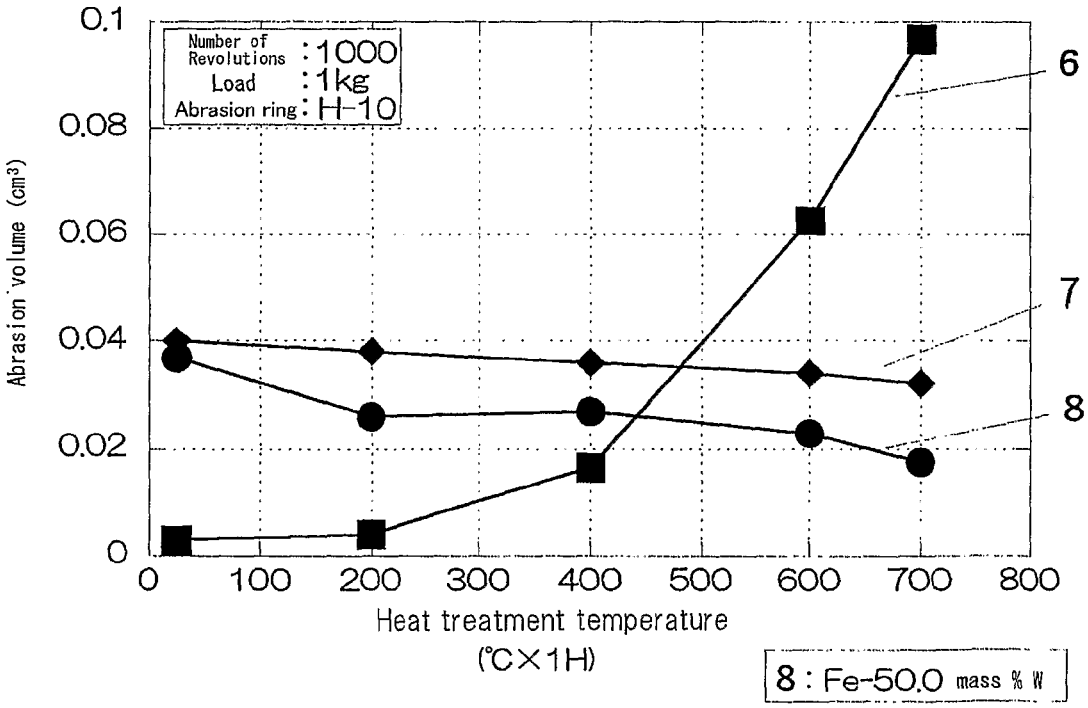
FIG. 4 shows abrasion resistance test data of Fe—W alloy, Cr and Co-10 mass % Ni alloy, obtained by a taper method.

Four doughnut-shaped discs made of SS400, each having a size of 100 mm in diameter×1 mm in thickness with a small hole having a diameter of 7 mm in the center, were prepared, and one side of each of the discs was subjected to a citric acid bath composed of 0.1 M ferrous sulfate, 0.15 M sodium tungstate and 0.3 M ammonium citrate so that, under conditions of a bath temperature of 50° C., pH6 and a current density of 7 A/dm$^2$, an iron-tungsten alloy plating process with a target of 50 mass % of iron was carried out thereon with a target thickness of 50 μm, and the plated disc was subjected to a heat treatment under conditions of 200° C.×1H, 400° C.×1H, 600° C.×1H and 700° C.×1H; thus, the resulting disc was evaluated on its abrasion property by using a taper-type abrasion testing method (JIS-H-8503, flat-plate rotary abrasion testing method). FIG. 4 shows the results of evaluations.

Moreover, the same doughnut-shaped discs as described above for use in comparison were prepared, and by using a known Sargent chromium bath and a cobalt-nickel sulfamate plating bath, a chromium-plating process and a cobalt-10 mass % nickel alloy plating process were carried out thereon with a target thickness of 50 μm, and the same heat treatment and Taber's abrasion test were carried out thereon. FIG. 4 shows the results.

Evaluation Example 4

By using an iron-tungsten alloy bath of Example 1, an alloy with a target tungsten content of 50 mass % was formed on the surfaces of ES70 cupper plates, each having a size of 50 mm in width×100 mm in length×10 mm in thickness, with thicknesses of 10, 30, 50 and 100 μm respectively, and one ES70 copper plate having the same size on which a cobalt-10 mass % nickel alloy, which is currently used in most cases as a coating for a continuous casting mold, was formed with a thickness of 100 μm was prepared in a separate manner, and this was plated with an iron-50 mass % tungsten alloy. Each of these plates were divided into two pieces, and formed into a size of about 50 mm in square; thus, thermal shock tests one cycle of which included processes in which one of these was held under a condition of 500° C.×48H, which was a severer condition than the conventional condition, while the other was held under a condition of 700° C.×10 minutes, and then charged into cold water, were repeated 20 cycles so that the surface was subjected to a light lapping process, and then subjected to a molten zinc test of 500° C.×48H. Any of the test pieces had no problems with the molten zinc erosion resistant property and anchoring property. In other words, the iron-tungsten alloy coating was allowed to serve as a superior barrier layer against molten zinc, with a coating thickness of only 10 μm, even when applied onto a copper base layer and even when applied onto a cobalt-nickel alloy. Moreover, when a thermal shock was preliminarily applied thereto, the coating hardness was increased so that, although fine cracks occurred locally, a superior barrier property against molten zinc and a superior peeling property of solidified zinc were obtained.

Example 2

Pseudo-Process Roll of Molten Zinc Plating Line

On the assumption that the product should be applied to a process roll for the hot plate galvanizing line, a rod made of SUS304 having 50 mm in diameter×100 mm in length was prepared, and by using a citric acid bath used in Evaluation Example 3, this was coated with a tungsten alloy having an iron-60 mass % target, with a target thickness of 100 μm; thus, a pseudo-process roll for the hot dip galvanizing line was produced.

Evaluation Example 5

The pseudo-process roll obtained in Example 2 was subjected to a buff polishing process and finished to have 0.8 μRz, and immersed in the hot dip galvanizing bath at 480° C. successively for 5 days.

For use in comparison, a rod made of SUS304 on which no iron-tungsten alloy was formed was used, and subjected to a buff polishing process in the same manner as described above, and finished to have 0.8 μRz, and immersed in the hot dip galvanizing bath at 480° C. successively for 5 days.

The presence or absence of anchored zinc after the immersing process was evaluated as described below.

Zinc was anchored onto the rod made of SUS304 for use in comparison; however, in the case of the pseudo-process roll coated with iron-tungsten alloy, zinc was easily removed, and no changes were found in its dimension. When one portion of the pseudo-process roll was cut and the amount of tungsten analyzed by EPMA was 58.8 mass %. Moreover, when the coating was observed under an optical microscope on its cross section, no erosion of zinc into SUS304 of the base material was found, although cracks in hair-line state were observed on several portions.

As clearly described above, the iron-tungsten alloy plating containing 10 mass % or more tungsten, more preferably, 20 to 60 mass %, has not only a superior barrier property and peeling property against molten zinc, but also a higher hardness in a plated state than a cobalt-nickel alloy, so that when heated, it exerts an increased hardness and the resulting superior anti-scratch property and abrasion resistance. Therefore, in the case when the coating is applied to a continuous casting mold, the coating may be partially formed in a part or the whole in the vicinity of meniscus of the casting mold that is particularly susceptible to erosion due to molten zinc; alternatively, not limited to the vicinity of the meniscus, the coating may be formed so as to cover the entire inner wall face of the casting mold. Moreover, among known mold coating materials, a material that is hardly susceptible to heat cracks due to thermal stress, for example, cobalt-nickel alloy plating, may be used as an under layer, with a part or the whole thereof being coated with the iron-tungsten alloy. FIG. 1 shows an example of an applied mode of an iron-tungsten alloy coating for the continuous casting mold; however, the present invention is not intended to be limited thereby. Furthermore, the iron-tungsten alloy plating is allowed to exert its effects even with a small thickness of 10 μm so that the thickness thereof is not particularly limited. However, because of its high hardness, there is sometimes a limitation in a manufacturing method so as to obtain proper shape precision. Therefore, in an attempt not to improve the two properties of the abrasion resistance and the barrier property against molten zinc, but only to improve the barrier property against zinc, the coating of the present invention may be applied only to a part susceptible to erosion due to molten zinc of a coating structure having a conventional mode in which, for example, a cobalt-nickel alloy coating, which is comparatively low in hardness, but has considerable abrasion resistance and superior extension in the coating, is thinly formed on the upper part of a mold, and thickly formed on the lower part of the mold.

Here, since the iron-tungsten alloy coating contains iron as its constituent component, it is slightly inferior in anti-discoloring property; and for this reason, a very thin chromium plated layer may be formed on the coating, or a commercially available discoloration inhibitor and fats and oils may be applied thereto, without causing any problems.

As described above, the high-level barrier property against molten zinc of the iron-tungsten alloy coating is applicable not only to the continuous casting process of molten steel containing zinc as impurities, but also to continuous casting process of brass containing zinc and process rolls utilized in a plating line of molten zinc and its alloy for steel plates (for example, sink rolls, support rolls, etc.), as well as to zinc die cast molds. As a result, the life time of the surface treatment reproducing cycle of the process roll to be used in a mold and a molten zinc bath can be prolonged, and the usable period of time of the base material up to disposal can be prolonged greatly, providing great advantages in the industrial field.

Moreover, the iron-tungsten alloy coating does not require any large-size vacuum chamber used for producing the coating through an electroplating process, and consequently has high general purpose properties. Moreover, different from a spraying method having a problem of wasteful use of a material in which the amount of a material actually utilized for forming a coating on a product is smaller than the amount of the material which has been wastefully sprayed and disposed, the coating of the present invention does not cause such problem, and is of course superior in adhesion.

Example 3

Onto a pair of wide-face copper plates (copper plate material: ES70, size: 2,000 mm in width×900 mm in length×30 mm in plate thickness) was formed a Co-10 mass % Ni alloy plated layer with a thickness of 0.2 mm within a range of 300 mm (in the vicinity of meniscus position) from the upper part downward as well as with a thickness of 1.2 mm in a range of 300 mm to the lower part, and the surface was finely finished. With respect to the finished face of the copper plate, a part within 300 mm from the upper part was further coated with Fe-50 mass % W alloy plating with a thickness of 0.03 mm by utilizing a platinum-plated titanium anode with an anode chamber partitioned by ion exchange films, under conditions of a temperature of 60° C. and a current density of 5 A/dm$^2$, by using a tartaric acid bath. The resulting pair of copper plates having a Fe-50 mass % W alloy coating was attached to a casting machine to be used as a casting mold.

INDUSTRIAL APPLICABILITY

The product of the present invention is applicable not only to a continuous casting process of molten steel containing zinc as impurities, but also to a continuous casting process of brass containing zinc, as well as to rolls, such as sink rolls and support rolls, utilized in the hot dip galvanizing line for steel plates. As a result, the life time of the surface treatment reproducing cycle of the process roll to be used in a mold and a molten zinc bath can be prolonged, and the usable period of time of the base material up to disposal can be prolonged greatly, providing great advantages in the industrial field.

The invention claimed is:

1. A continuous casting mold with an electromagnetic stirring function, wherein a cobalt-nickel alloy coating is thickly formed on a lower part of an inner surface of the mold, and a cobalt-nickel alloy coating is thinly formed on an upper part of the inner surface of the mold, including a meniscus position such that the thickness of the cobalt-nickel alloy coating on the lower part is greater than that of on the upper part of the inner surface of the mold, and the cobalt-nickel alloy coating formed on the upper part of the inner surface of the mold is plated with an iron-tungsten alloy coating.

2. The continuous casting mold according to claim 1, which is a continuous casting mold for molten steel containing zinc as impurities or for brass containing zinc as an alloy component.

3. The continuous casting mold according to claim 1, wherein the content of tungsten in the iron-tungsten coating is 10 mass % or more.

4. The continuous casting mold according to claim 1, wherein the content of tungsten in the iron-tungsten coating is 20 to 60 mass %.

5. The continuous casting mold according to claim 1, wherein the thickness of the iron-tungsten alloy coating is 0.5 μm or more.

6. The continuous casting mold according to claim 1, wherein the thickness of the iron-tungsten alloy coating is 10 to 300 μm.

* * * * *